US009994059B2

(12) United States Patent
Araki et al.

(10) Patent No.: US 9,994,059 B2
(45) Date of Patent: Jun. 12, 2018

(54) DATA EDITING APPARATUS AND PROGRAM

(71) Applicant: RISO KAGAKU CORPORATION, Tokyo (JP)

(72) Inventors: Asuka Araki, Ibaraki-ken (JP); Ayako Kawano, Ibaraki-ken (JP); Mayumi Okawa, Ibaraki-ken (JP); Kouichi Nobushima, Ibaraki-ken (JP); Hideo Nakao, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 937 days.

(21) Appl. No.: 13/776,258

(22) Filed: Feb. 25, 2013

(65) Prior Publication Data

US 2013/0223957 A1 Aug. 29, 2013

(30) Foreign Application Priority Data

Feb. 28, 2012 (JP) ..... 2012-041179

(51) Int. Cl.
*B42F 21/00* (2006.01)
*B42D 15/00* (2006.01)
*B42C 11/04* (2006.01)

(52) U.S. Cl.
CPC ..... *B42C 11/04* (2013.01); *B42F 21/00* (2013.01)

(58) Field of Classification Search
USPC ..... 283/36, 37, 38, 41, 42, 43, 67, 70, 72, 283/74, 81
See application file for complete search history.

(56) References Cited

U.S. PATENT DOCUMENTS

2012/0063867 A1* 3/2012 Kanamoto ..... 412/1
2012/0146322 A1* 6/2012 Erisalu ..... 283/81

FOREIGN PATENT DOCUMENTS

JP 2010-131758 A 6/2010

* cited by examiner

*Primary Examiner* — Justin V Lewis
(74) *Attorney, Agent, or Firm* — Studebaker & Brackett PC

(57) ABSTRACT

When data about plural book sheets, each belonging to one of plural chapters, are edited to bind the plural book sheets by a casing-in operation in such a manner that chapter range images, which indicate the respective ranges of the plural chapters, are displayed on an edge so that the chapter range images that are adjacent to each other are arranged at different positions from each other in the top-bottom direction, a marker image emphasizing the chapter range image is adjacent to the chapter range image indicating the range of a chapter having book sheets the number of which is less than or equal to a predetermined threshold.

5 Claims, 9 Drawing Sheets

DATA EDITING APPARATUS AND PROGRAM

BACKGROUND OF THE INVENTION

Field of the Invention

The present invention relates to a data editing apparatus and program for casing-in bookbinding. In particular, the present invention relates to a data editing apparatus and program for casing-in bookbinding that makes it possible to recognize the range of each chapter by observing an edge of a book produced by bookbinding.

Description of the Related Art

Conventionally, casing-in bookbinding is known. In casing-in bookbinding, a book is produced by wrapping, with a cover, a book sheet block in which plural sheets of book paper are bound (hereinafter, "book paper" will also be referred to as book sheet). Further, there is a demand for recognizing an approximate location of each chapter in the book sheet block by observing an edge of the book.

Japanese Unexamined Patent Publication No. 2010-131758 (Patent Document 1) proposes a technique for displaying an image of a chapter number on an edge at a position corresponding to each chapter. The image of the chapter number is displayed on the edge by printing slice images of the chapter number, obtained by slicing the image of the chapter number, at ends of book sheets corresponding to the chapter number.

However, the technique proposed in Patent Document 1 requires a complicated process of generating slice images. Therefore, a technique for displaying plural chapter range images, which indicate the respective ranges of chapters, on an edge in the order of chapter numbers in a top-bottom direction is also known. The plural chapter range images are displayed by printing a chapter image representing a chapter number at ends of book sheets corresponding to each chapter.

SUMMARY OF THE INVENTION

However, when a chapter has a small number of pages, it is difficult to recognize the chapter range image of the chapter. Therefore, there is a risk that finding an approximate location of book sheets belonging to such a chapter having a small number of pages in the book sheet block is troublesome.

In view of the foregoing circumstances, it is an object of the present invention to provide a data editing apparatus and program that makes it possible to easily recognize the chapter range of a chapter having a small number of pages.

To solve the aforementioned problem, a data editing apparatus of the present invention is a data editing apparatus that edits data about a plurality of book sheets, each belonging to one of a plurality of chapters, to bind the plurality of book sheets by a casing-in operation in such a manner that chapter range images, which indicate the respective ranges of the plurality of chapters, are displayed on an edge so that the chapter range images that are adjacent to each other are arranged at different positions from each other in the top-bottom direction, and the data editing apparatus comprising:

a marker image edit unit that edits the data in such a manner that a marker image emphasizing the chapter range image is adjacent to the chapter range image indicating the range of a chapter having book sheets the number of which is less than or equal to a predetermined threshold.

A data editing program of the present invention makes the marker image edit unit, function as a marker image edit means, to cause a computer function as the data editing apparatus.

In the data editing apparatus and program of the present invention, the term "book sheet" means paper on which letters, numbers, drawings, photographs and the like, which constitute the main body of a book, are printed. The phrase "data about book sheets" means image data about book sheets to print the main body of a book on paper for the book. The expression "edit data about book sheets" means editing data representing book sheets, and editing is not limited to changing the position, the size and the direction of a letter, an image or the like that is already present in a book sheet. Editing may include addition of a new letter, image or the like to a book sheet. Further, the term "adjacent" is not necessarily limited to a contact state, but includes a state of being located in the neighborhood. Further, the term "top-bottom direction" means a direction from the top of a book toward the bottom of the book or a direction from the bottom of the book toward the top of the book.

In the data editing apparatus of the present invention, the marker image edit unit may edit data in such a manner that a marker image is adjacent to a chapter range image at least on one side of the chapter range image in a direction orthogonal to a top-bottom direction.

Further, in the data editing apparatus of the present invention, data may be edited in such a manner that the marker image is displayed in a range of a chapter immediately before a chapter having book sheets the number of which is less than or equal to a predetermined threshold, and the range corresponding to a predetermined number of pages from the last page of the chapter immediately before the chapter and/or in a range of a chapter immediately after the chapter having the book sheets the number of which is less than or equal to the predetermined threshold, and the range corresponding to a predetermined number of pages from the first page of the chapter immediately after the chapter.

Here, the phrase "chapter immediately before a chapter" means a chapter immediately before a chapter having book sheets the number of which is less than or equal to a predetermined threshold. Further, the phrase "chapter immediately after the chapter" means a chapter immediately after the chapter having book sheets the number of which is less than or equal to the predetermined threshold.

Alternatively, in the data editing apparatus of the present invention, the marker image edit unit may edit data in such a manner that a marker image is displayed in the whole range of a chapter immediately before the chapter having book sheets the number of which is less than or equal to the predetermined threshold and/or in the whole range of a chapter immediately after the chapter having book sheets the number of which is less than or equal to the predetermined threshold.

According to the data editing apparatus and program of the present invention, when data about a plurality of book sheets, each belonging to one of a plurality of chapters, are edited to bind the plurality of book sheets by a casing-in operation in such a manner that chapter range images, which indicate the respective ranges of the plurality of chapters, are displayed on an edge so that the chapter range images that are adjacent to each other are arranged at different positions from each other in the top-bottom direction, the data are edited in such a manner that a marker image emphasizing the chapter range image is adjacent to the chapter range image indicating the range of a chapter having book sheets the number of which is less than or equal to a predetermined threshold. The marker image emphasizes the chapter range image of a chapter having pages the number of which is less than or equal to a predetermined threshold, and the chapter range image becomes clearly noticeable. Therefore, the chapter range of a chapter having pages the number of which is less than or equal to the predetermined threshold becomes easily recognizable.

According to the data editing apparatus of the present invention, data may be edited in such a manner that the marker image is adjacent to the chapter range image at least on one side of the chapter range image in a direction orthogonal to a top-bottom direction. Therefore, the marker image makes the width of the chapter range image having a small number of pages clearly noticeable. Hence, the chapter range of a chapter having pages the number of which is less than or equal to a predetermined threshold becomes easily recognizable.

Further, according to the data editing apparatus of the present invention, data may be edited in such a manner that the marker image is displayed in a range of a chapter immediately before the chapter having book sheets the number of which is less than or equal to the predetermined threshold, and the range corresponding to a predetermined number of pages from the last page of the chapter immediately before the chapter and/or in a range of a chapter immediately after the chapter having the book sheets the number of which is less than or equal to the predetermined threshold, and the range corresponding to a predetermined number of pages from the first page of the chapter immediately after the chapter. Therefore, the chapter range of a chapter having pages the number of which is less than or equal to a predetermined threshold becomes easily recognizable while the degree of emphasis by the marker image is adjusted.

According to the data editing apparatus of the present invention, data may be edited in such a manner that a marker image is displayed in the whole range of a chapter immediately before the chapter having book sheets the number of which is less than or equal to the predetermined threshold and/or in the whole range of a chapter immediately after the chapter having book sheets the number of which is less than or equal to the predetermined threshold. Therefore, the chapter range of a chapter having pages the number of which is less than or equal to a predetermined threshold becomes easily recognizable while mixture of a book sheet on which a marker image is displayed and a book sheet on which no marker image is displayed is prevented in the chapter immediately before the chapter and/or in the chapter immediately after the chapter.

Note that the program of the present invention may be provided being recorded on a computer readable medium. Those who are skilled in the art would know that computer readable media are not limited to any specific type of device, and include, but are not limited to: floppy disks, CD's RAM's, ROM's, hard disks, magnetic tapes, and internet downloads, in which computer instructions can be stored and/or transmitted. Transmission of the computer instructions through a network or through wireless transmission means is also within the scope of this invention. Additionally, computer instructions include, but are not limited to: source, object and executable code, and can be in any language including higher level languages, assembly language, and machine language.

DESCRIPTION OF THE PREFERRED EMBODIMENTS

Figure 1:
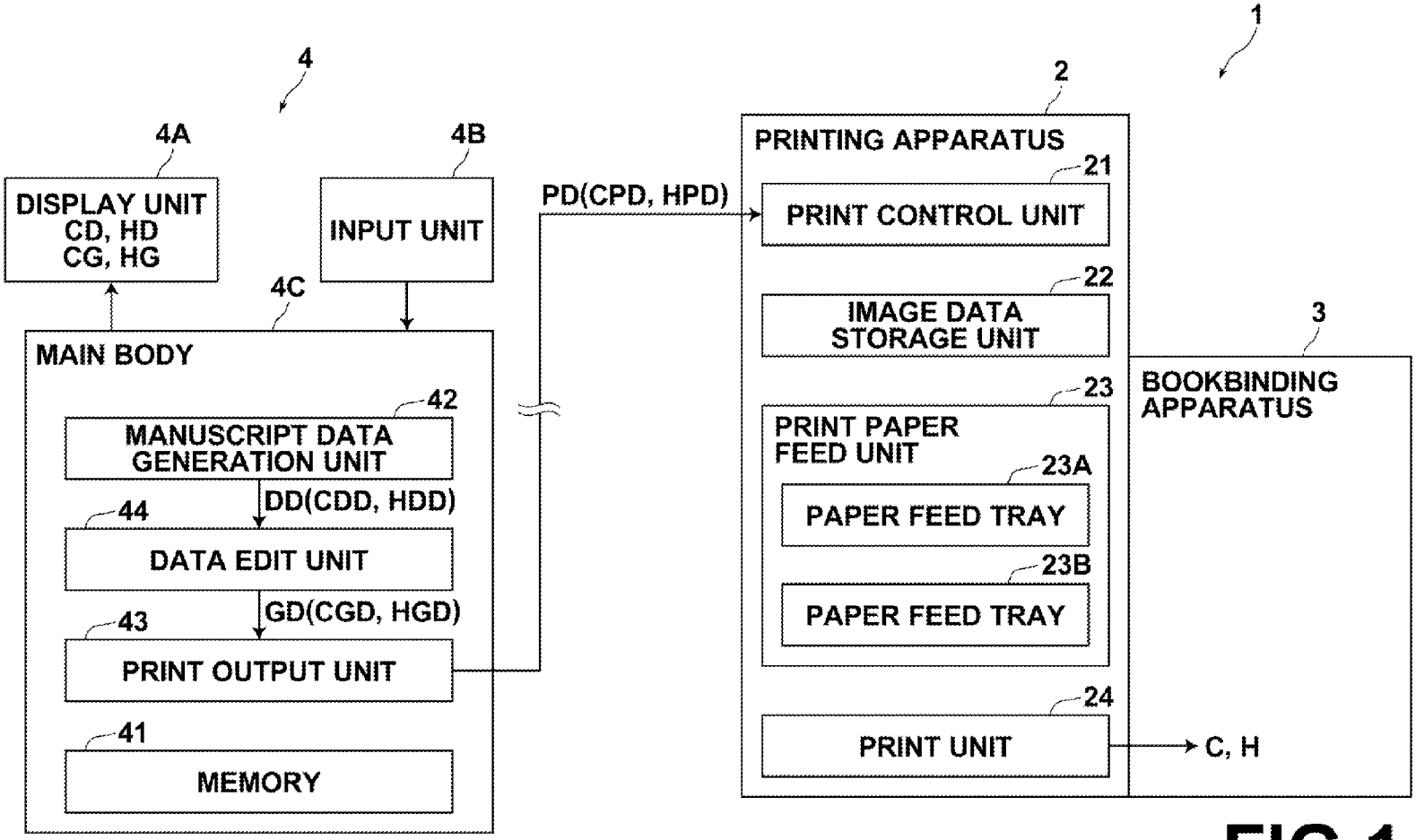
FIG. 1 is a schematic diagram illustrating the configuration of a casing-in bookbinding system.

Hereinafter, embodiments of the present invention will be described with reference to drawings. FIG. 1 is a schematic diagram illustrating the configuration of a casing-in bookbinding system 1 using a data edit unit 44 according to an embodiment of the present invention. As illustrated in FIG. 1, the casing-in bookbinding system 1 includes a printing apparatus 2, a bookbinding apparatus 3 next to the printing apparatus 2, and a computer 4 connected to the printing apparatus 2 through a network.

In the casing-in bookbinding system 1, the computer 4 generates manuscript data DD, and generates image data GD based on the manuscript data DD, and generates print data PD based on the image data GD. Further, the printing apparatus 2 prints out a sheet of cover C and plural book sheets H based on the print data PD. Further, the bookbinding apparatus 3 produces a book by binding the plural book sheets H, and by wrapping the plural book sheets H with the cover C.

The manuscript data DD include cover manuscript data CDD, which represent a manuscript of the cover C (hereinafter, referred to as cover manuscript CD), and book sheet manuscript data HDD, which represent a manuscript of the book sheets H (hereinafter, referred to as book sheet manuscript HD).

The image data GD include cover image data CGD, which represent a print image of the cover C (hereinafter, referred to as cover image CG), and plural sets of book sheet image data HGD, which represent print images of the plural book sheets H (hereinafter, referred to as book sheet images HG).

The print data PD include cover print data CPD, which are print job data of the cover C, and book sheet print data HPD, which are print job data of the book sheets H. The print data PD are composed of PDL (Page Description Language) data or raster data.

First, the printing apparatus 2 will be described. The printing apparatus 2 receives print data PD from the computer 4 through a network, and prints out a sheet of cover C on paper for the cover based on cover print data CPD and plural book sheets H on paper for the book sheets based on book sheet print data HPD. The printing apparatus 2 includes a print control unit 21, an image data storage unit 22, a print paper feed unit 23, and a print unit 24.

The print control unit 21 controls the whole printing apparatus 2 by controlling each unit of the printing apparatus 2. Further, the print control unit 21 receives print data PD from the computer 4, and loads image data GD based on the print data PD. The print control unit 21 loads cover image data CGD based on cover print data CPD, and loads plural sets of book sheet image data HGD based on book sheet print data HPD.

The image data storage unit 22 stores the cover image data CGD and the plural sets of book sheet image data HGD until printing is performed.

The print paper feed unit 23 feeds paper for a cover or paper for book sheets to the print unit 24. The print paper feed unit 23 stores paper for a cover in a paper feed tray 23A, and paper for book sheets in a paper feed tray 23B.

The print unit 24 prints a sheet of cover C and/or plural book sheets H based on image data GD. The print unit 24 prints cover image CG on paper for a cover based on cover image data CGD. The print unit 24 prints book sheet images HG on paper for book sheets based on book sheet image data HGD. As the print unit 24, a stencil print printer, an inkjet printer, a laser printer, and the like may be used.

The book sheet print data HPD also include number-of-pages information and print condition information indicating whether printing is one side printing or both sides printing. The print control unit 21 calculates, based on these kinds of information, the thickness of the book sheet block. The thickness is calculated by multiplying the total number of book sheets H by the thickness of a book sheet H. The print control unit 21 makes the print unit 24 print a cover in an appropriate size for the thickness.

Next, the bookbinding apparatus 3 will be described. The bookbinding apparatus 3 is a casing-in bookbinding apparatus, and produces a book by binding plural book sheets H to make a book sheet block, and by wrapping the book sheet block with cover C after applying adhesive to a spine-side side surface of the book sheet block. Further, the bookbinding apparatus 3 may produce the book by cutting the book sheet block at a position away from the edge-side (fore-edge-side) side surface of the book sheet block by a predetermined distance, and at a position away from the top-side side surface of the book sheet block by a predetermined distance, and at a position away from the bottom-side side surface of the book sheet block by a predetermined distance (hereinafter, referred to as edge trimming).

Next, the computer 4 will be described. The computer 4 includes a display unit 4A, an input unit 4B, and a main body 4C. The display unit 4A is a display device, such as a liquid crystal monitor, and displays a manuscript data generation program, a printer driver, and a data edit program, which will be described later. The input unit 4B is an input device, such as a keyboard, a mouse, and a pointer device. The input unit 4B receives an instruction for the manuscript data generation program, the printer driver, and the data edit program by a user.

The main body 4C includes a central processing unit (CPU), a semiconductor memory, a hard disk, and the like. The computer 4 functions as a manuscript data generation unit 42, a print output unit 43, and a data edit unit 44 by installation of the manuscript data generation program, the printer driver, and the data edit program in the memory 41.

The memory 41 stores the manuscript data generation program, the printer driver, the data edit program, manuscript data DD and image data GD. The manuscript data DD and the image data GD may be generated by a computer other than the computer 4.

The manuscript data generation unit 42 generates manuscript data DD. As the manuscript data generation program, a program, such as Word, Excel (Registered Trademark), and Power Point (Registered Trademark) of Microsoft, may be used to generate a manuscript. Further, a program, such as a PDF (Registered Trademark) driver, may be used to convert the manuscript into manuscript data.

The manuscript data generation unit 42 generates cover manuscript CD and book sheet manuscript HD based on an operation received by the input unit 4B while the cover manuscript CD and the book sheet manuscript HD are displayed on the display unit 4A. Further, the manuscript data generation unit 42 generates manuscript data DD in PDF (Portable Document Format) format. The manuscript data generation unit 42 adds chapter information about a chapter to which each page of the book sheet manuscript HD belongs to the book sheet manuscript data HDD.

The print output unit 43 receives image data GD from the data edit unit 44, and generates print data PD, and outputs the print data PD to the printing apparatus 2. The printer driver is started by a print operation by the data edit unit 44.

The data edit unit 44 according to an embodiment of the present invention generates image data GD based on manuscript data DD. The data edit unit 44 generates cover image data CGD based on the cover manuscript data CDD, and generates plural sets of book sheet image data HGD based on the book sheet manuscript data HDD.

Figure 2:
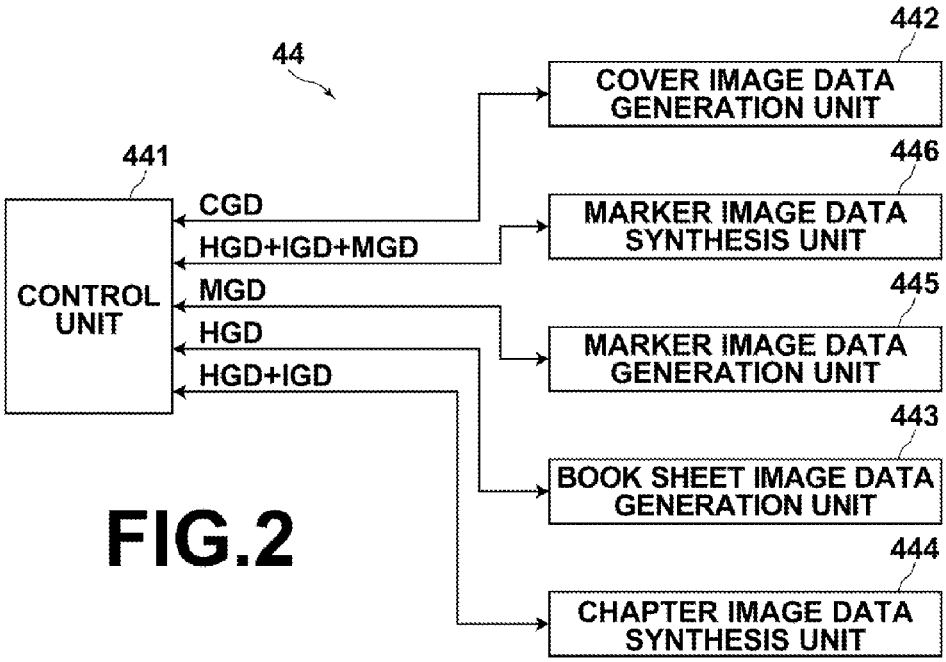
FIG. 2 is a block diagram of a data edit unit.

FIG. 2 is a block diagram of the data edit unit 44. As illustrated in FIG. 2, the data edit unit 44 includes a control unit 441, a cover image data generation unit 442, a book sheet image data generation unit 443, a chapter image data synthesis unit 444, a marker image data generation unit 445 and a maker image data synthesis unit 446.

A control unit 441 controls the whole data edit unit 44 by controlling each unit of the data edit unit 44. The control unit 441 reads out, from the memory 41, manuscript data DD that have been specified by a user and received by the input unit 4B.

Figure 3A:
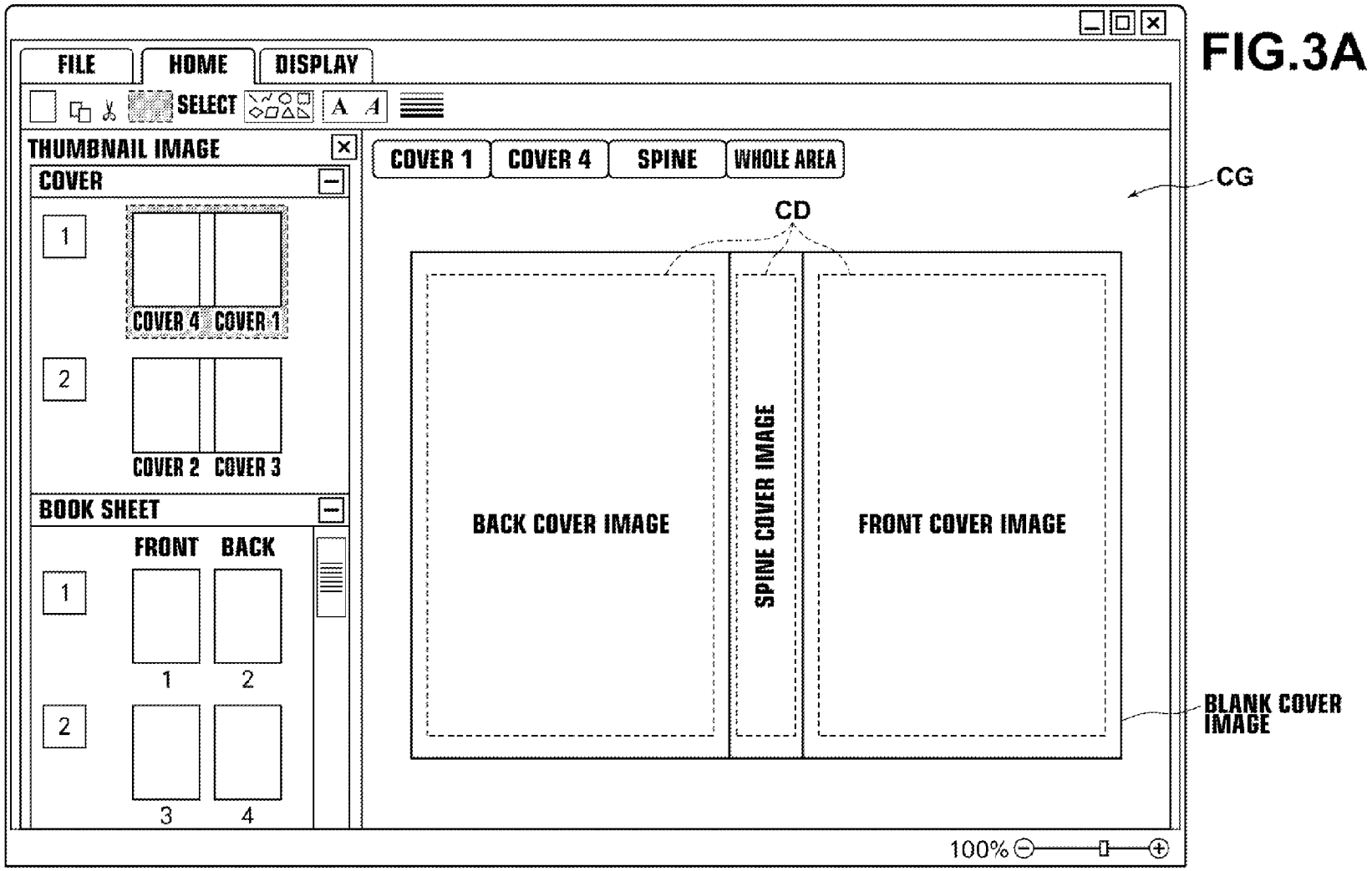
FIG. 3A is a diagram illustrating a screen for editing cover print image (No. 1)
Figure 3B:
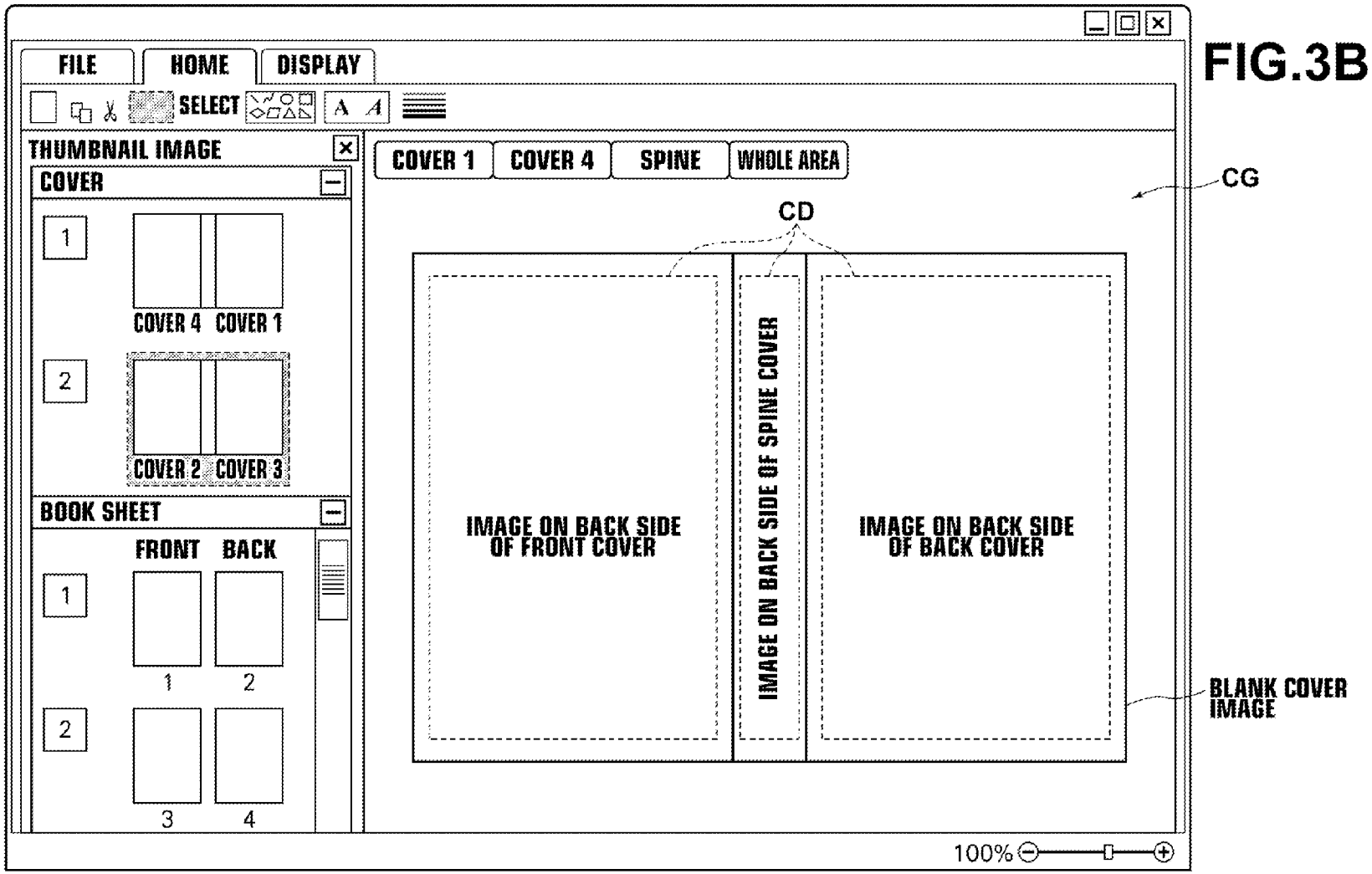
FIG. 3B is a diagram illustrating a screen for editing cover print image (No. 2)

The cover image data generation unit 442 generates cover image data CGD based on cover manuscript data CDD. FIGS. 3A and 3B illustrate screens for editing cover image CG. As illustrated in FIGS. 3A and 3B, the cover image data generation unit 442 displays cover image CG by arranging cover manuscript CD in a blank cover image. Further, the cover image data generation unit 442 displays thumbnail images of the cover image CG.

A user operates the input unit 4B so that the cover manuscript CD in the blank cover image has a desirable position, direction and size while referring to the cover image CG. The cover image data generation unit 442 generates cover image data CGD by editing the cover image CG based on operation information received by the input unit 4B.

As illustrated in FIGS. 3A and 3B, the cover image CG includes a front cover image, a spine cover image, a back cover image, an image on the back side of a front cover, an image on the back side of a spine cover, and an image on the back side of a back cover. FIGS. 3A and 3B illustrate cover image CG of cover C for left-side binding. However, the cover C is not limited to the cover C for left-side binding. The cover image CG may be applied to a cover for right-side binding or a cover for top binding.

The cover image data generation unit 442 may change the order of arrangement of the front cover image, the spine cover image, the back cover image, the image on the back side of the front cover, the image on the back side of the spine cover, and the image on the back side of the back cover in the blank cover image. The cover image data generation unit 442 may change the order of arrangement of the images based on binding position information for bookbinding that has been received by the input unit 4B, in other words, whether the cover C is left-side binding, or right-side binding, or top binding.

Figure 4:
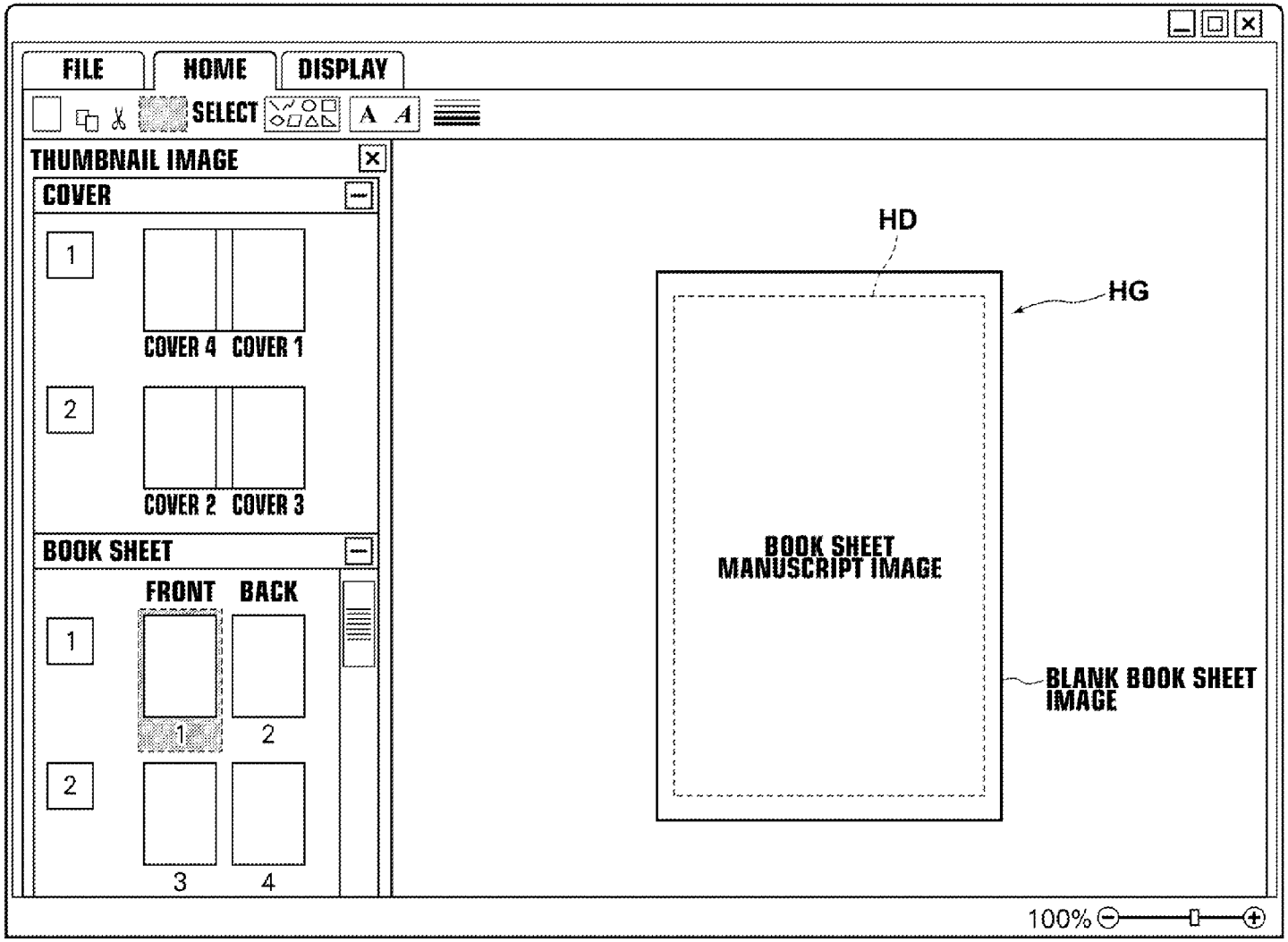
FIG. 4 is a diagram illustrating a screen for editing book sheet print image.

The book sheet image data generation unit 443 generates plural sets of book sheet image data HGD that are used to print book sheets based on book sheet manuscript data HDD. FIG. 4 illustrates a screen for editing book sheet image HG. As illustrated in FIG. 4, the book sheet image data generation unit 443 arranges book sheet manuscript HD in a blank book sheet image and displays each book sheet image HG in the order of pages based on the book sheet manuscript data HDD. Further, the book sheet image data generation unit 443 displays a thumbnail image of each book sheet image HG.

A user operates the input unit 4B so that the book sheet manuscript HD in the blank cover image has a desirable position, direction and size while referring to the book sheet image HG. The book sheet image data generation unit 443 generates book sheet image data HGD by editing book sheet image HG based on operation information received by the input unit 4B.

Further, the book sheet image data generation unit 443 arranges, based on imposition setting information received by the input unit 4B, book sheet manuscript HD corresponding to the number of pages of imposition setting in a book sheet blank image. Further, the book sheet image data generation unit 443 displays identification as to whether each book sheet image HG belongs to a front side of a book sheet or a back side of the book sheet. The book sheet image data generation unit 443 displays such identification based on print condition information received by the input unit 4B. The print condition information represents whether print is one side printing or both sides printing.

Figure 5A:
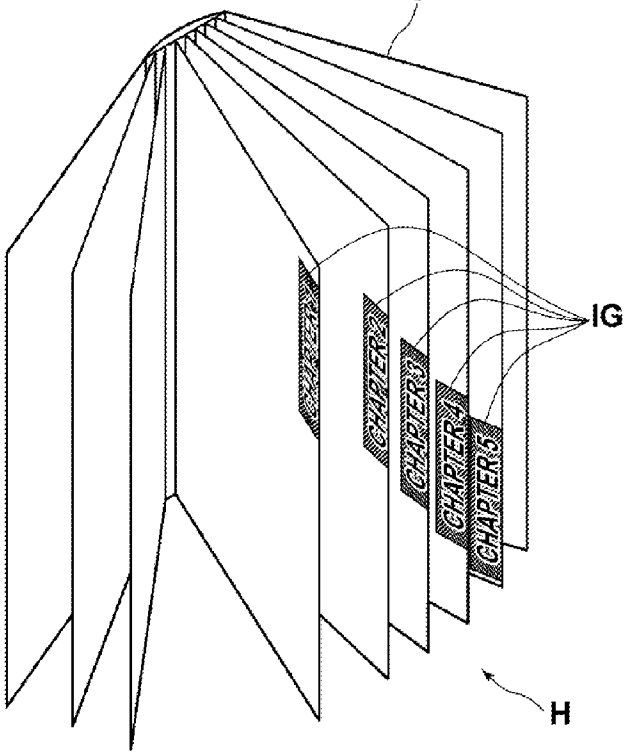
FIG. 5A is a schematic diagram illustrating a relationship between chapter images and chapter range images.
Figure 5B:
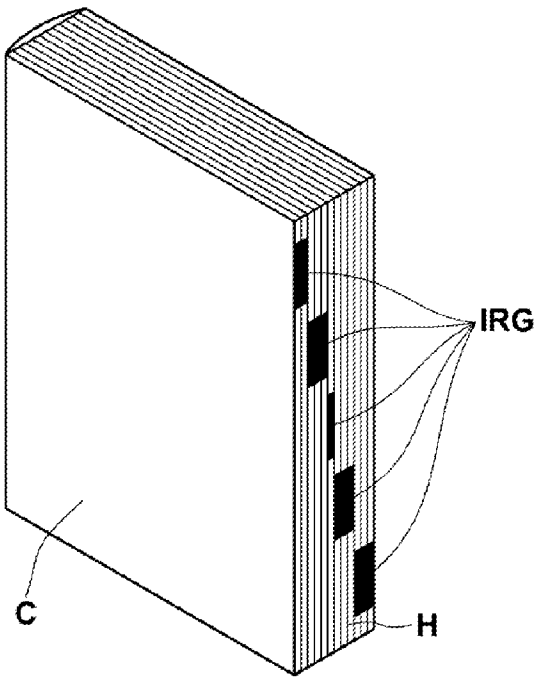
FIG. 5B is a schematic diagram illustrating a relationship between chapter images and chapter range images.

FIGS. 5A and 5B are schematic diagrams illustrating a relationship between chapter images and chapter range images. As illustrated in FIGS. 5A and 5B, the chapter image data synthesis unit 444 synthesizes chapter image data IGD for each set of book sheet image data HGD in such a manner that each chapter range image IRG is arranged in the order of chapter numbers in the top-bottom direction. The chapter image data IGD represent the chapter range image IRG, which represents the range of each chapter on an edge of the book, and chapter image IG, which represents a chapter number at an edge-side end of book sheet H. In the present embodiment, the chapter range image IRG is displayed in such a manner that all of chapter range images IRG are arranged in the order of chapter numbers in the top-bottom direction. Alternatively, each chapter range image IRG having a specific chapter number, for example, such as chapter 5, chapter 10 and chapter 15, may be displayed on the topmost side of the edge, and chapter range images IRG having chapter numbers following the respective specific chapter numbers may be displayed in the order of chapter numbers in the top-bottom direction after the respective chapter range images IRG having the specific chapter numbers.

In the present embodiment, book sheets H are bound on the left side of the book. Therefore, chapter range image IRG of the first chapter is arranged on the upper (top) left side of the edge, and chapter range image IRG of the last chapter is arranged on the lower (bottom) right side of the edge. Chapter image IG is not particularly limited as long as the image includes a chapter number and a straight line portion for displaying chapter range image IRG. The straight line portion is printed in an area within 3 mm from the edge-side end of each book sheet H.

In the present embodiment, the chapter image data synthesis unit 444 synthesizes, based on chapter information that has been added to book sheet manuscript data HDD, chapter image data IGD for each set of book sheet image data HGD corresponding to the respective chapter numbers. Alternatively, the chapter image data synthesis unit 444 may synthesize the chapter image data IGD based on chapter information of each set of book sheet manuscript data HDD received by the input unit 4B.

The marker image data generation unit 445 generates marker image data MGD representing marker image MG and marker piece image MPG. The marker image MG is adjacent to chapter range image IRG on the edge of a closed book. The marker piece image MPG is arranged at the edge-side end of each book sheet H. The marker image MG and the marker piece image MPG will be described in detail later.

The marker image data synthesis unit 446 obtains the number of pages of each chapter. Further, the marker image data synthesis unit 446 synthesizes marker image data MGD in each set of book sheet image data HGD, in which chapter image data IGD have been synthesized. The marker image data synthesis unit 446 synthesizes the marker image data MGD in such a manner that marker image MG emphasizing chapter range image IRG of a chapter having pages the number of which is less than or equal to a predetermined threshold is adjacent to the chapter range image IRG.

The marker image data synthesis unit 446 synthesizes marker image data MGD for each set of book sheet image data HGD belonging to a chapter having three or less pages in one side printing and a chapter having six or less pages in both sides printing. These thresholds may be stored in advance, or received by the input unit 4B.

Figure 6:
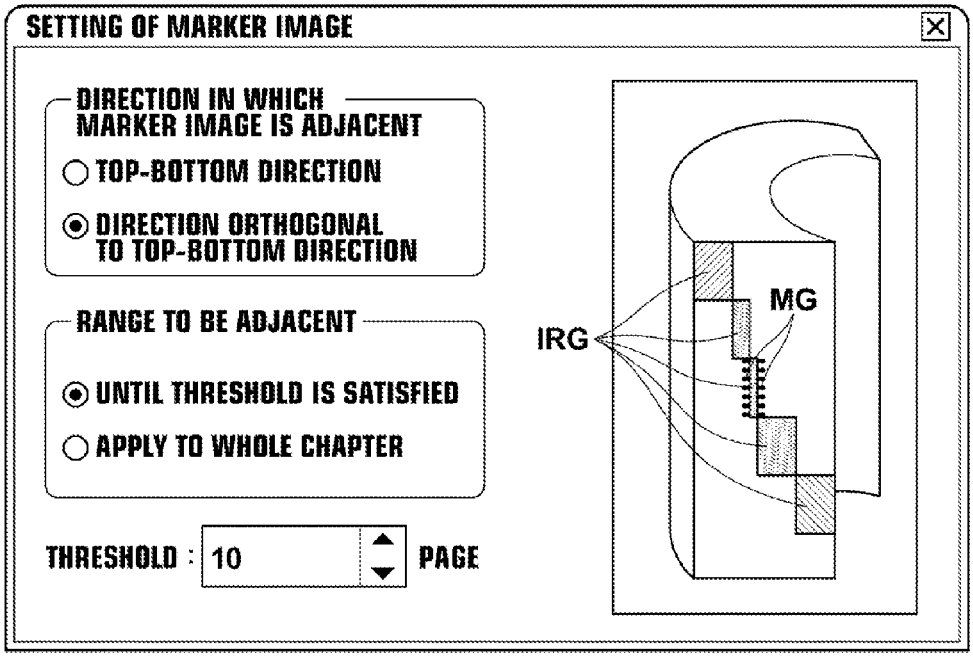
FIG. 6 is a diagram illustrating a screen for setting a marker image (No. 1)
Figure 8:
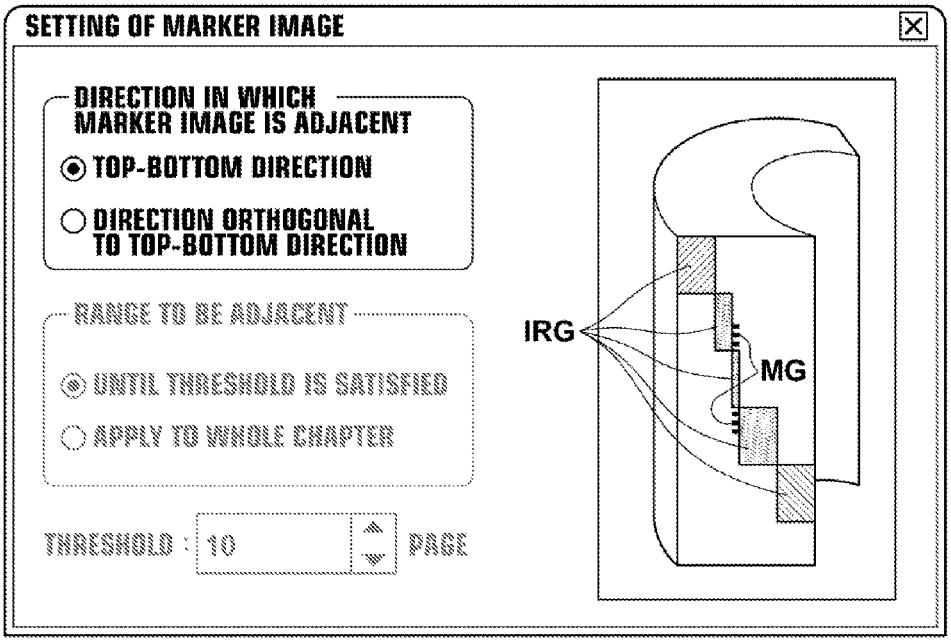
FIG. 8 is a diagram illustrating a screen for setting a marker image (No. 2)

FIGS. 6 and 8 are diagrams illustrating screens for setting marker image MG. When the marker image data synthesis unit 446 synthesizes marker image data MGD, the marker image data synthesis unit 446 makes the input unit 4B receive instructions including a direction in which marker image MG is adjacent (a direction in which marker image MG is adjacent to chapter range image IRG) and a range to be adjacent (a range in which marker image MG is adjacent to chapter range image IRG) by displaying a screen for setting marker image MG, as illustrated in FIGS. 6 and 8, on the display unit 4A.

When the input unit 4B receives an instruction that the direction in which the marker image MG is adjacent is a direction orthogonal to the top-bottom direction, the marker image data synthesis unit 446 synthesizes marker image data MGD in each set of book sheet image data HGD belonging to a chapter immediately before and/or a chapter immediately after a chapter having pages the number of which is less than or equal to a predetermined threshold, and in which chapter image data IGD have been synthesized. The marker image data MGD are synthesized in such a manner that the marker image MG is adjacent to the chapter range image of the chapter having pages the number of which is less than or equal to the predetermined threshold in a direction orthogonal to the top-bottom direction, as illustrated in FIG. 6.

Figures 7A, 7B, 7C:
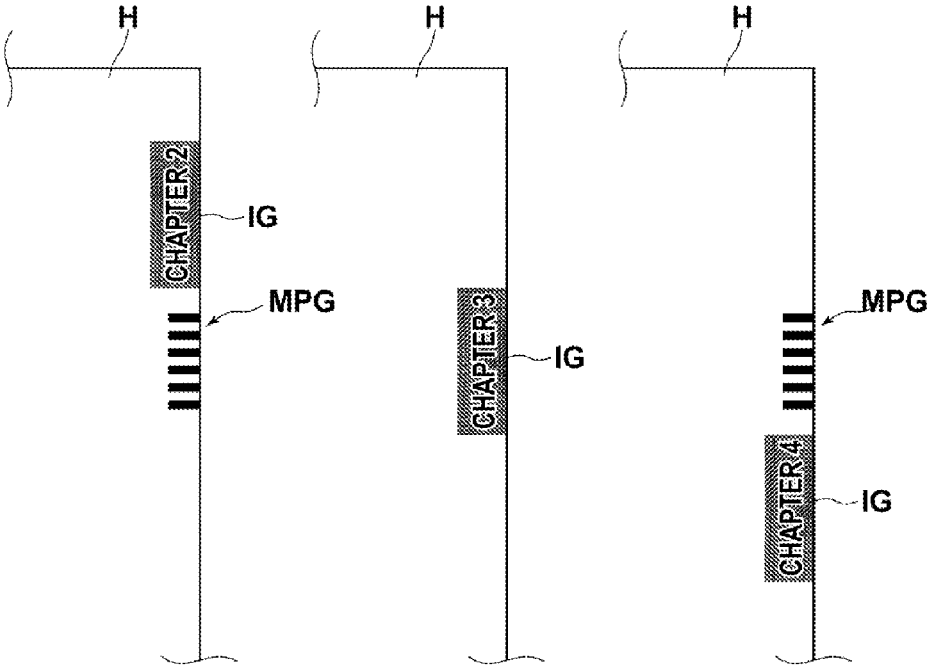
FIG. 7A is a schematic diagram illustrating a relationship between a chapter image and a marker piece image (No. 1)
FIG. 7B is a schematic diagram illustrating a relationship between a chapter image and a marker piece image (No. 1)
FIG. 7C is a schematic diagram illustrating a relationship between a chapter image and a marker piece image (No. 1)

FIGS. 7A through 7C are diagrams illustrating a relationship between chapter image IG and a marker piece image when a direction in which marker image MG is adjacent is a direction orthogonal to the top-bottom direction. In the present embodiment, it is assumed that the number of pages of chapter 3 is less than or equal to a predetermined threshold. Therefore, marker image MG is adjacent to chapter range image IRG of chapter 3. Hence, as illustrated in FIG. 7A, marker piece image MPG is printed on each of at least a part of book sheets H belonging to chapter 2, and the marker piece image MPG is printed at a position corresponding to the position of chapter 3. Further, as illustrated in FIG. 7C, marker piece image MPG is printed on each of at least a part of book sheets H belonging to chapter 4, and the marker piece image MPG is printed at a position corresponding to the position of chapter 3.

The marker piece image MPG is not particularly limited as long as the image has a straight line portion extending in a top-bottom direction to display the marker image MG. It is desirable that the straight line portion of the marker piece image MPG is printed in an area within 3 mm from the edge-side end of book sheet H. It is more desirable that the straight line portion is printed at the edge-side end of book sheet H. Further, the straight line portion is not limited to a portion. As illustrated in FIGS. 7A and 7C, plural straight line portions may be present. Further, it is desirable that the total length of the straight line portions is greater than or equal to 50% of the length of chapter image IG in the top-bottom direction. It is more desirable that the total length of the straight line portions is greater than or equal to 80% of the length of chapter image IG in the top-bottom direction.

Further, the marker image MG is not particularly limited. The marker image data synthesis unit 446 may synthesize marker image data MGD representing marker image MG the size, the shape or the color of which is different from that of chapter range image IRG of a chapter having pages the number of which is less than or equal to a predetermined threshold. Accordingly, the chapter range image IRG of the chapter having pages the number of which is less than or equal to the predetermined threshold becomes more clearly noticeable. Further, when the marker image MG is adjacent to the chapter range image IRG in a direction orthogonal to the top-bottom direction, the chapter range of the chapter having pages the number of which is less than or equal to the predetermined threshold is not erroneously recognized as the chapter range of a chapter immediately before and/or the chapter range of a chapter immediately after the chapter. Hence, it is possible to more easily recognize the chapter range of the chapter having pages the number of which is less than or equal to the predetermined threshold.

When the chapter having pages the number of which is less than or equal to a predetermined threshold is the first chapter of a book, the marker image data synthesis unit 446 may synthesize the marker image data MGD in each set of book sheet image data HGD belonging to a chapter immediately after the chapter having pages the number of which is less than or equal to the predetermined threshold, in which chapter image data IGD have been synthesized. Then, the marker image data MGD are synthesized in such a manner that the marker image MG is arranged, next to the chapter, only immediately after the chapter in a direction orthogonal to the top-bottom direction. In contrast, when the chapter having pages the number of which is less than or equal to a predetermined threshold is the last chapter of the book, the marker image data synthesis unit 446 may synthesize the marker image data MGD in each set of book sheet image data HGD belonging to a chapter immediately before the chapter having pages the number of which is less than or equal to the predetermined threshold, in which chapter image data IGD have been synthesized. Then, the marker image data MGD are synthesized in such a manner that the marker image MG is arranged, next to the chapter, only immediately before the chapter in a direction orthogonal to the top-bottom direction.

Accordingly, even if it is difficult to arrange marker image MG on both sides of chapter range image IRG, the marker image data synthesis unit 446 can emphasize the chapter range of a chapter having pages the number of which is less than or equal to a predetermined threshold, and the chapter range becomes easily recognizable.

When the input unit 4B receives an instruction that the range in which the marker image MG is adjacent is the whole chapter immediately before and/or the whole chapter immediately after the chapter having pages the number of which is less than or equal to the predetermined threshold, the marker image data synthesis unit 446 may synthesize marker image data MGD in each set of book sheet image data HGD belonging to the chapter immediately before and/or the chapter immediately after the chapter having pages the number of which is less than or equal to the predetermined threshold, and in which chapter image data IGD have been synthesized. The marker image data MGD are synthesized in such a manner that the marker image MG for all the pages of the chapter immediately before and/or all the pages of the chapter immediately after the chapter is adjacent to the chapter range image IRG in a direction orthogonal to the top-bottom direction. In other words, the marker image MG for all the pages of a chapter is adjacent at least on one side of the chapter range image IRG.

Accordingly, the marker image MG for all the pages of the chapter immediately before and/or all the pages of the chapter immediately after the chapter having pages the number of which is less than or equal to the predetermined threshold can make the chapter range image IRG of the chapter clearly noticeable. Therefore, the chapter range of the chapter having pages the number of which is less than or equal to the predetermined threshold is emphasized more, and becomes easily recognizable.

When the input unit 4B receives an instruction that the range in which the marker image MG is adjacent is a predetermined number of pages of the chapter immediately before and/or a predetermined number of pages of the chapter immediately after the chapter having pages the number of which is less than or equal to the predetermined threshold, the marker image data synthesis unit 446 may synthesize marker image data MGD in each set of book sheet image data HGD belonging to the chapter immediately before and/or the chapter immediately after the chapter having pages the number of which is less than or equal to the predetermined threshold, and in which chapter image data IGD have been synthesized. The marker image data MGD are synthesized in such a manner that the marker image MG for a predetermined number of pages from the last page of the chapter immediately before and/or a predetermined number of pages from the first page of the chapter immediately after the chapter is adjacent to the chapter range image IRG in a direction orthogonal to the top-bottom direction. In other words, the marker image MG is adjacent at least on one side of the chapter range image IRG.

Accordingly, the marker image MG for a desirable number of pages of the chapter immediately before and/or a desirable number of pages of the chapter immediately after the chapter having pages the number of which is less than or equal to the predetermined threshold can make the chapter range image IRG of the chapter clearly noticeable. Therefore, the chapter range of the chapter having pages the number of which is less than or equal to the predetermined threshold is not erroneously recognized as the chapter range of the chapter immediately before and/or the chapter range of the chapter immediately after the chapter. Hence, it is possible to easily recognize the chapter range of the chapter having pages the number of which is less than or equal to the predetermined threshold.

When the input unit 4B receives an instruction that the direction in which the marker image MG is adjacent is the top-bottom direction, the marker image data synthesis unit 446 synthesizes marker image data MGD in each set of book sheet image data HGD belonging to the chapter having pages the number of which is less than or equal to the predetermined threshold, and in which chapter image data IGD have been synthesized. The marker image data MGD are synthesized in such a manner that the marker image MG is adjacent to the chapter range image IRG of the chapter having pages the number of which is less than or equal to the predetermined threshold in the top-bottom direction, as illustrated in FIG. 8.

Figure 9:
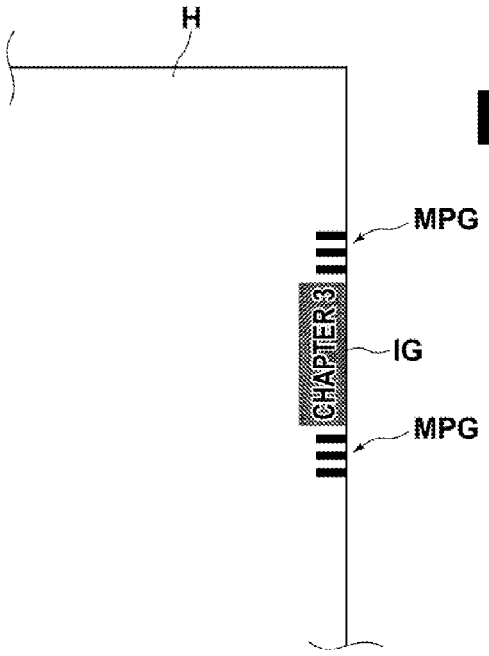
FIG. 9 is a schematic diagram illustrating a relationship between a chapter image and marker piece images (No. 2)

FIG. 9 is a diagram illustrating a relationship between chapter image IG and marker piece images MPG when the direction in which the marker image MG is adjacent is the top-bottom direction. As illustrated in FIG. 9, the marker piece images MPG are printed on each book sheet H belonging to chapter 3 in such a manner that the marker piece images MPG are arranged on both sides of the chapter image IG in the top-bottom direction. The marker image synthesis unit 446 synthesizes marker image data MGD for all sets of book sheet image data HGD belonging to chapter 3. Alternatively, the marker image synthesis unit 446 may synthesize marker image data MGD for book sheet image data HGD corresponding to a predetermined number of pages belonging to chapter 3.

Figure 10:
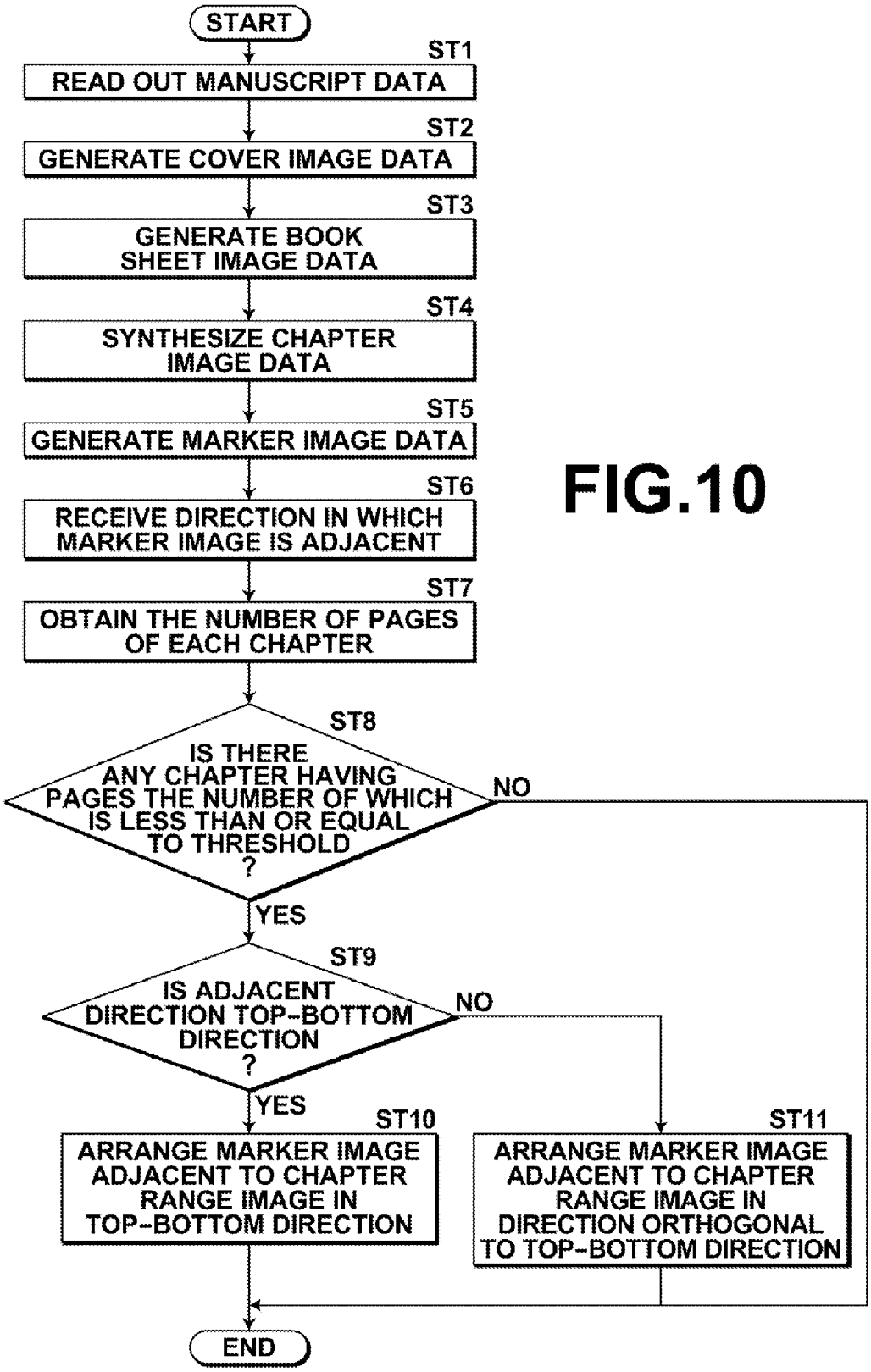
FIG. 10 is a flow chart illustrating a series of processing by a data edit unit.

Next, the action of the data edit unit 44 will be described. FIG. 10 is a flow chart illustrating a series of processing performed by the data edit unit 44. First, the control unit 441 reads manuscript data DD specified by a user (step ST1). The cover image data generation unit 442 generates cover image data CGD based on cover manuscript data CDD (step ST2).

The book sheet image data generation unit 443 generates book sheet image data HGD based on book sheet manuscript data HDD (step ST3). The chapter image data synthesis unit 444 synthesizes each set of chapter image data IGD in each set of book sheet image data HGD (step ST4).

The marker image data generation unit 445 generates marker image data MGD (step ST5). The marker image data synthesis unit 446 receives an instruction about a direction in which marker image MG is adjacent by displaying a screen for setting marker image MG (step ST6). The marker image data synthesis unit 446 calculates the number of pages of each chapter (step ST7).

The marker image data synthesis unit 446 judges whether the number of pages of each of all the chapters is less than or equal to a predetermined threshold (step ST8). If the number of pages of at least one of the chapters is less than or equal to the predetermined threshold, the marker image data synthesis unit 446 checks whether the direction in which the marker image MG is adjacent is a top-bottom direction or not (step ST9). If the direction in which the marker image MG is adjacent is the top-bottom direction, the marker image data synthesis unit 446 synthesizes marker image data MGD in each set of book sheet image data HGD, in which chapter image data IGD have been synthesized, in such a manner that the marker image MG is adjacent in the top-bottom direction (step ST9). If the direction in which the marker image MG is adjacent is not the top-bottom direction, the marker image data synthesis unit 446 synthesizes marker image data MGD in each set of book sheet image data HGD, in which chapter image data IGD have been synthesized, in such a manner that the marker image MG is adjacent in a direction orthogonal to the top-bottom direction, and ends processing.

Further, the marker image data synthesis unit 446 ends processing also when the number of pages of each of all the chapters exceeds the predetermined threshold. Here, the order of processing for generating book sheet image data HGD and processing for generating cover image data CGD is not particularly limited.

Finally, the action of the whole casing-in bookbinding system 1 will be described. The computer 4 starts a manuscript data generation program, and displays data on the display unit 4A. The manuscript data generation unit 42 generates manuscript data DD based on an operation received by the input unit 4B. The computer 4 starts a data edit program, and displays data on the display unit 4A.

The data edit unit 44 generates image data GD based on an operation received by the input unit 4B. When the data edit unit 44 executes print processing, a printer driver is started, and the print output unit 43 generates print data PD based on image data GD. The print output unit 43 outputs the print data PD to the printing apparatus 2. The printing apparatus 2 prints a sheet of cover C and plural book sheets H based on the print data PD. Further, the bookbinding apparatus 3 binds the plural book sheets H, and wraps the book sheet block of the plural book sheets with the cover C to produce a book.

In the present embodiment, a case in which marker image data MGD are generated has been described. Alternatively, the marker image data MGD may be received from the outside. Further, in the present embodiment, chapter image data IGD are synthesized in book sheet image data HGD, and further, marker image data MGD are synthesized. Alternatively, processing for displaying chapter range image IRG and marker image MG may be performed without synthesizing such data separately.

As described above, the data edit unit 44 edits data in such a manner that marker image MG is adjacent to chapter range image IRG of a chapter having pages the number of which is less than or equal to a predetermined threshold. Therefore, the marker image MG emphasizes the chapter range image IRG of the chapter having pages the number of which is less than or equal to the predetermined threshold, and the chapter range image IRG becomes clearly noticeable. Hence, the chapter range of the chapter having pages the number of which is less than or equal to the predetermined threshold becomes easily recognizable.

Further, the data edit unit 44 may edit data in such a manner that the shape, the size or the color of marker image MG is different from that of chapter range image IRG. In such a case, the chapter range image IRG is emphasized, and becomes more clearly noticeable. Hence, it is possible to more easily recognize the chapter range of a chapter having pages the number of which is less than or equal to the predetermined threshold.

What is claimed is:

1. A data editing apparatus that edits data about a plurality of book sheets of a book, each book sheet belonging to one of a plurality of chapters, to bind the plurality of book sheets by a casing-in operation in such a manner that chapter range images, which indicate respective ranges of the plurality of chapters, are displayed on an edge of the book so that the chapter range images that are adjacent to each other are arranged at different positions from each other in a top-bottom direction, and the data editing apparatus comprising:

a marker image edit unit that judges whether a number of pages of each chapter is less than or equal to a setting threshold and edits the data in such a manner that a marker image emphasizing the chapter range image is adjacent to the chapter range image indicating the range of a chapter having book sheets the number of which is less than or equal to the setting threshold.

2. A data editing apparatus, as defined in claim 1, wherein the marker image edit unit edits the data in such a manner that the marker image is adjacent to the chapter range image at least on one side of the chapter range image in a direction orthogonal to a top-bottom direction.

3. A data editing apparatus, as defined in claim 2, wherein the marker image edit unit edits the data in such a manner that the marker image is displayed in a range of a chapter immediately before the chapter having book sheets the number of which is less than or equal to the setting threshold, and the range corresponding to a predetermined number of pages from the last page of the chapter immediately before the chapter and/or in a range of a chapter immediately after the chapter having the book sheets the number of which is less than or equal to the setting threshold, and the range corresponding to a predetermined number of pages from the first page of the chapter immediately after the chapter.

4. A data editing apparatus, as defined in claim 2, wherein the marker image edit unit edits the data in such a manner that the marker image is displayed in the whole range of a chapter immediately before the chapter having book sheets the number of which is less than or equal to the predetermined threshold and/or in the whole range of a chapter immediately after the chapter having book sheets the number of which is less than or equal to the setting threshold.

5. A computer program product comprising a non-transitory computer-readable recording medium storing therein a data editing program for causing a computer to function as a marker image edit unit to edit data about a plurality of book sheets of a book, each book sheet belonging to one of a plurality of chapters, to bind the plurality of book sheets by a casing-in operation in such a manner that chapter range images, which indicate respective ranges of the plurality of chapters, are displayed on an edge of the book so that the chapter range images that are adjacent to each other are arranged at different positions from each other in a top-bottom direction, wherein the marker image edit unit judges whether a number of pages of each chapter is less than or equal to a setting threshold and edits the data in such a manner that a marker image emphasizing the chapter range image is adjacent to the chapter range image indicating the range of a chapter having book sheets the number of which is less than or equal to the setting threshold.

* * * * *